US005878717A

United States Patent [19]

Zur Loye

[11] Patent Number: 5,878,717

[45] Date of Patent: Mar. 9, 1999

[54] CYLINDER PRESSURE BASED AIR-FUEL RATIO AND ENGINE CONTROL

[75] Inventor: Axel Otto Zur Loye, Columbus, Ind.

[73] Assignee: Cummins Engine Company, Inc., Columbus, Ind.

[21] Appl. No.: 44,863

[22] Filed: Mar. 20, 1998

Related U.S. Application Data

[62] Division of Ser. No. 773,854, Dec. 27, 1996, Pat. No. 5,765,532.

[51] Int. Cl.[6] ..... F02D 41/00; F02M 7/00

[52] U.S. Cl. ..... 123/435; 123/568.11; 123/676; 123/479; 701/108

[58] Field of Search ..... 123/435, 479, 123/568.11, 568.14, 676, 674, 672; 73/35.12; 701/104, 108

[56] References Cited

U.S. PATENT DOCUMENTS

| | | | |
|---|---|---|---|
| 4,327,688 | 5/1982 | Lowther | 123/435 |
| 4,621,603 | 11/1986 | Matekunas | 123/425 |
| 4,622,939 | 11/1986 | Matekunas | 123/435 |
| 4,624,229 | 11/1986 | Matekunas | 123/425 |
| 4,694,799 | 9/1987 | Yagi et al. | 123/435 |
| 4,736,724 | 4/1988 | Hamburg et al. | 123/435 |
| 4,896,642 | 1/1990 | Washino et al. | 123/435 |
| 4,903,665 | 2/1990 | Washino et al. | 123/435 |
| 4,971,009 | 11/1990 | Washino et al. | 123/435 |
| 4,996,960 | 3/1991 | Nishiyama et al. | 123/435 |
| 5,038,737 | 8/1991 | Nishiyama et al. | 123/435 |
| 5,067,463 | 11/1991 | Remboski et al. | 123/435 |
| 5,107,813 | 4/1992 | Inoue et al. | 123/435 |
| 5,245,969 | 9/1993 | Nishiyama et al. | 123/435 |
| 5,359,975 | 11/1994 | Katashiba et al. | 123/435 |
| 5,361,745 | 11/1994 | Suzuki et al. | 123/435 |
| 5,474,045 | 12/1995 | Demizu et al. | 123/435 |
| 5,592,919 | 1/1997 | Morikawa | 123/435 |
| 5,632,257 | 5/1997 | Machida et al. | 123/568.16 |
| 5,636,614 | 6/1997 | Morikawa | 123/435 |
| 5,703,285 | 12/1997 | Shimizu et al. | 701/108 |
| 5,765,532 | 6/1998 | Loye | 123/435 |

FOREIGN PATENT DOCUMENTS

| | | | |
|---|---|---|---|
| 58-185945 | 10/1983 | Japan | F02D 51/00 |

*Primary Examiner*—Willis R. Wolfe
*Assistant Examiner*—Hieu T. Vo
*Attorney, Agent, or Firm*—Sixbey, Friedman, Leedom & Ferguson; Charles M. Leedom, Jr.

[57] ABSTRACT

A system and method for controlling an air-fuel ratio of an internal combustion engine using a ratio of cylinder pressures measured within at least one cylinder. The air-fuel ratio control system includes an electronic control module (ECM) which computes a measured cylinder pressure ratio of the cylinder pressure measured at a predetermined crank angle before top dead center and the cylinder pressure measured at a predetermined crank angle after top dead center. The measured cylinder pressure ratio is compared with an optimal cylinder pressure ratio. Based upon the results of this comparison, the ECM then determines an adjusted air-fuel ratio which would modify the measured pressure ratio to equal the optimal pressure ratio. This system controls the air-fuel ratio by measuring the quality of combustion without the need to measure the amount of air or fuel actually delivered to the engine. The measured pressure ratio corresponds to an excess air ratio of the internal combustion engine at those operating conditions, wherein a measured excess air ratio of the engine may be obtained from the computed pressure ratio. The measured excess air ratio may be compared with an optimal excess air ratio for the specific engine operating conditions currently being sensed, wherein the ECM then determines the adjusted air-fuel ratio which would modify the measured excess air ratio to equal the stored optimal excess air ratio.

34 Claims, 8 Drawing Sheets

P(psia)
2000
1800
1600
1400
1200
1000
800
600
400
200
0
-40
-20
0
20
40
60
CRANKANGLE
240
241
242
243
244
245

AHR
(BTU/degree)
0.30
0.25
0.20
0.15
0.10
0.05
0.00
-0.05
-40
-20
0
20
40
60
CRANKANGLE
230
231
232
233
234
235

CYLINDER PRESSURE BASED AIR-FUEL RATIO AND ENGINE CONTROL

This application is a divisional of U.S. Ser. No. 08/773,854 filed Dec. 27, 1996.

BACKGROUND OF THE INVENTION

1. Techincal Field

The present invention relates to an air-fuel ratio and engine control system for internal combustion engines. More particularly, the present invention relates to the control of the air-fuel ratio and other engine parameters in response to a ratio of cylinder pressures as a function of rotational crankshaft angles.

2. Background Art

Currently, various methods of controlling the combustion process in internal combustion engines are known. Adjustments to controlling the energy conversion function of an engine during combustion are obtained by sensing at least one engine operating condition, such as coolant temperature, manifold pressure, engine speed, mass airflow into the engine, throttle angle, fuel temperature, fuel pressure, fuel rate, EGR rate, exhaust emissions, etc., and adjusting the energy conversion in response thereto. Usually, engine control is determined by varying certain engine operating conditions on a control reference engine to determine the proper energy conversion for the various operating conditions. The problem encountered with this approach is that the engine being controlled is not necessarily the same as the control test engine used for reference, due to manufacturing differences and aging. Therefore, the operating condition being sensed can provide an inaccurate control variable for engine control. In order to overcome this problem, a control system must be implemented with the capability to adjust for these differences and changes. Such a control system is possible using combustion chamber pressure sensors and applying feedback control to ignition timing, EGR rate, or fuel rate.

In a typical engine control, the three controlled combustion parameters are spark timing, EGR rate, and air-fuel ratio. The first parameter affects the timing of the initiation of the combustion process and the latter two affect the speed and duration of the combustion process, while all three parameters affect engine emissions. Air-fuel ratio is generally controlled in a closed loop by an exhaust oxygen sensor to produce a constant stoichiometric ratio for emission control by oxidizing and reducing catalysts in the exhaust system. Since the efficiency of one or the other catalyst falls rapidly as the air-fuel ratio strays even slightly from stoichiometric in either direction, this parameter must be strictly controlled and is not available for maximizing power or fuel efficiency. Internal combustion engines in most cars today typically operate stoichiometrically. Stoichiometric conditions exist when there is exactly the right amount of oxygen available to convert all of the fuel molecules to $CO_2$ and $H_2O$. Under these conditions, there is very little, if any, oxygen in the exhaust to prevent the oxygen from interfering with the catalytic removal of $NO_X$ emissions. Furthermore, there is also virtually no unburned fuel or CO in the exhaust.

However, it has been found that there are situations when it is advantageous to operate with a very lean air-fuel ratio rather than a stoichiometric air-fuel ratio, such as to produce better fuel economy or reduce exhaust emissions. Lean mixtures provide numerous additional advantages as well, such as lowering combustion temperatures which lowers $NO_X$ emissions, increasing efficiency through a higher ratio of specific heats, lowering exhaust temperatures which increases durability, especially at high loads, and having a greater knock margin which allows higher compression ratios to be used resulting in better efficiency. When operating with a very lean air-fuel ratio, existing exhaust gas oxygen sensors cannot accurately measure the exhaust oxygen concentration, which results in inaccurate control of the air-fuel ratio. Therefore, it is desirable to provide an engine control system that easily and reliably is able to control engine operation at lean air-fuel ratios.

As previously stated, combustion chamber pressure sensors can be utilized along with applying feedback control to provide control of engine operation. One such system is disclosed in U.S. Pat. No. 4,996,960 issued to Nishiyama et al., which teaches an air-fuel ratio control system for an internal combustion engine using a ratio of two cylinder pressure measurements, one at top dead center (TDC) and one at 60° before TDC (BTDC), in conjunction with the intake air temperature to calculate a correction for the delivered fuel flow during acceleration or deceleration and thus changing the air-fuel ratio. This control system uses the well known polytropic behavior of the air-fuel mixture that is typically observed during the compression stroke in the cylinder to estimate the charging efficiency and, once the charging efficiency is known, to correct for changes in air flow without the use of an air flow meter. Nishiyama et al. teach taking all cylinder pressure measurements at or before TDC, which is prior to combustion, and their control system does not measure any parameters during the actual combustion event. Therefore, this air-fuel ratio control system would not be able to accurately control the air-fuel ratio of a lean burn engine, which requires the quality of combustion to be monitored.

U.S. Pat. No. 4,622,939 issued to Matekunas discloses a method of controlling spark timing for achieving the best torque in an internal combustion engine by comparing the ratio of combustion chamber pressure to motored pressure for several predetermined crankshaft rotational angles, namely at least 10° and 90° ATDC. The motored pressure is a calculated value of the estimated pressure at 10° and 90° ATDC based upon initial pressure measurements taken at 90° and 60° BTDC, and a ratio between the first and second ratios of combustion chamber pressure to motored pressure at 10° and 90° ATDC is calculated to adjust the ignition timing to maintain a predetermined ratio between the first and second pressure ratios for MBT. Therefore, this control system requires numerous calculations and additional sampling of the pressure signal to determine the motored pressures and all of the ratios as well as additional memory to store all of these calculations. Additionally, the pressure ratio calculated at 90° ATDC occurs at substantially complete combustion, wherein pressure measurements taken late in the combustion cycle are particularly sensitive to measurement errors, such as thermal shock. Thermal shock occurs as the transducer is exposed to hot and cold gases and its body deforms due to thermal expansion of the transducer body, which, in turn, moves the transducer's diaphragm and causes an error which is nearly impossible to remove. Therefore, measurements at substantially complete combustion as implemented by Matekunas are likely to have too great an error to allow adequate precision in the measured pressure ratio. Further, the purpose of the Matekunas invention is to adjust the spark timing to keep the 50% point of combustion relatively fixed in order to achieve MBT timing, and the Matekunas invention does not control the air-fuel ratio. Accordingly, there is a need for an engine control system which is not affected by thermal shock and which does not require a plurality of pressure samplings and a large amount of memory to store calculations of such pressure samplings. There is further a need for an engine control system which adequately functions with a lean air-fuel ratio.

One approach to controlling the operation of an internal combustion engine at lean air-fuel ratios is disclosed in U.S. Pat. No. 4,736,724 issued to Hamburg et al. This control system uses an in-cylinder pressure sensor and a sensor for monitoring the airflow into the engine in a combustion pressure feedback loop, wherein the sensors are attached to a compensation device coupled to the fuel controller. The compensation device modifies the fuel air command applied to the engine as a function of airflow and in-cylinder pressure. The engine's air-fuel ratio is maintained at the lean limit based on continuously measured in-cylinder combustion pressure signals. This control system performs a constant heat release calculation to measure the burn duration, and requires a fast time response in the feedback loop as the burn duration is compared with the lean limited preprogrammed in a burn duration table. Therefore, this control system requires a great deal of processing power and storage memory to continuously monitor the in-cylinder pressure to calculate burn duration. Furthermore, this control system requires the additional measurement of the airflow into the engine which further complicates the required components of the control system and adds another variable to the calculations, which increases the opportunity for error.

Accordingly, there is clearly a need for an engine control system which provides for effective control of the air-fuel ratio at lean conditions while not requiring a plurality of complex calculations and a large amount of memory to store such calculations. Further, there is a need for an engine control system which adequately controls an internal combustion engine at a lean air-fuel ratio in a simpler and more efficient manner.

SUMMARY OF THE INVENTION

It is an object of the present invention to overcome the aforementioned shortcomings associated with the prior art.

Another object of the present invention is to provide a system for controlling the air-fuel ratio of an internal combustion engine which does not require a plurality of complex measurements and calculations or a large amount of memory to store such measurements and calculations.

Yet another object of the present invention is to provide a system for controlling the air-fuel ratio of an internal combustion engine which does not need to measure the actual quantities of air or fuel delivered to the engine.

It is a further object of the present invention to provide a system for controlling the air-fuel ratio of an internal combustion engine by monitoring the quality of combustion within the cylinder of the engine.

It is yet another object of the present invention to provide a system for controlling the air-fuel ratio of an internal combustion engine in which the engine control is self-compensating for different qualities of fuel to ensure optimal engine operation, without having to know the particular characteristics of the fuel used.

A further object of the present invention is to provide a system for controlling the air-fuel ratio of an internal combustion engine using a ratio of cylinder pressures sensed within the cylinder combustion chambers of the engine.

It is another object of the present invention to provide a system for controlling the air-fuel ratio of an internal combustion engine without having to measure the cylinder pressure late in the combustion cycle where thermal shock errors are large relative to the measured pressure.

Yet another object of the present invention is to provide a reliable and accurate system for operating an internal combustion engine at lean air-fuel ratios.

Yet a further object of the present invention is to provide a system for controlling the air-fuel ratio of an internal combustion engine which is particularly sensitive to small changes in the air-fuel ratio when operating under lean burn conditions.

Another object of the present invention is to provide a system for controlling the air-fuel ratio of an internal combustion engine by controlling the excess air ratio of the engine.

It is a further object of the present invention to monitor the quality of combustion of an internal combustion engine by measuring the excess air ratio of the internal combustion engine.

A further object of the present invention is to provide an air-fuel ratio control system which detects misfires within the engine cylinders by monitoring a ratio of cylinder pressures in order to operate as close to the lean limit as possible.

Yet another object of the present invention is to measure the excess air ratio of an internal combustion engine using a ratio of cylinder pressures within the combustion chambers.

It is yet a further object of the present invention to monitor and adjust the quality of combustion of an internal combustion engine by providing a system which produces large changes in the cylinder pressure ratio in response to small changes in the excess air ratio when operating under lean air-fuel ratios.

It is still another object of the present invention to control the air-fuel ratio of the individual cylinders of an internal combustion engine to allow all of the cylinders to operate at the same excess air ratio.

These as well as additional objects and advantages of the present invention are achieved by providing a system for controlling an air-fuel ratio of an internal combustion engine having a cylinder pressure sensor positioned in at least one combustion chamber of an internal combustion engine for detecting a cylinder pressure in the combustion chamber, wherein the cylinder pressure sensor provides an output signal indicative of the cylinder pressure detected. Additional sensors are provided in the engine for sensing a plurality of engine operating conditions, such as engine speed, boost, and engine load, and providing output signals indicative of the operating conditions sensed. A control device is provided for adjusting the air-fuel ratio by controlling at least one of the amount of air and fuel delivered to the engine. The air-fuel ratio control system includes an electronic control module (ECM) which receives the signals from the cylinder pressure sensor and operation detecting sensors. The ECM computes a pressure ratio of a first cylinder pressure measured at a predetermined crank angle before top dead center and a second cylinder pressure measured at a predetermined crank angle after top dead center from the signals received from the cylinder pressure sensor. A cylinder pressure ratio information storage device containing the optimal cylinder pressure ratios for various engine operating conditions is stored in the memory of the ECM, wherein the measured pressure ratio of measured cylinder pressures is compared with an optimal cylinder pressure ratio stored in the information storage device, such as a look-up table, for the specific engine operating conditions currently being sensed. Based upon the results of the this comparison, the ECM then determines an adjusted air-fuel ratio which would modify the measured pressure ratio to equal the stored optimal pressure ratio. The ECM then provides a control signal to the air-fuel controller for adjusting at least one of the amount of air and fuel delivered to the engine to correspond to the adjusted air-fuel ratio. This system controls the air-fuel ratio without ever measuring the amount of air or fuel actually delivered to the engine in the preferred embodiment of the invention. However, in alternative embodiments of the present invention, the amount of air and fuel delivered to the engine can be measured to provide an estimated setting for the air-fuel ratio, where the cylinder pressure ratio can be used to fine tune the air-fuel ratio to a desired value.

The measured pressure ratio of measured cylinder pressures corresponds to an excess air ratio of the internal combustion engine at those operating conditions, wherein a measured excess air ratio of the engine may be obtained from the measured pressure ratio. In one embodiment of the present invention, the measured excess air ratio is compared with an optimal excess air ratio stored in an information table in the memory of the ECM for the specific engine operating conditions currently being sensed, wherein the stored optimal excess air ratio represents the ideal excess air ratio of the engine to operate optimally under the specific operating conditions sensed. The ECM then determines the adjusted air-fuel ratio which would modify the measured excess air ratio to equal the stored optimal excess air ratio.

The predetermined crank angles before top dead center and after top dead center are preferably symmetrical about top dead center in the range of approximately 10–30 degrees, for example 10° before top dead center and 10° after top dead center. The air-fuel ratio control system may further be adjusted to account for the amount of offset possessed by the cylinder pressure sensor by measuring the cylinder pressure at bottom dead center and the pressure in the intake manifold, wherein the offset of the cylinder pressure sensor is determined based upon the difference between the cylinder pressure and intake manifold pressure at bottom dead center. The gain of the cylinder pressure sensor may also be determined by calculating a ratio of cylinder pressures measured at two crank angles before top dead center and comparing this ratio with a target pressure ratio to determine the gain of the cylinder pressure sensor using the well-known polytropic behavior during the cylinder compression process.

BRIEF DESCRIPTION OF THE DRAWINGS

FIG. 5(*b*) is a graphical representation of the cylinder pressure during combustion for different excess air ratios as a function of crank angle for a selected engine operating condition;

DETAILED DESCRIPTION OF THE PREFERRED EMBODIMENT

Figure 1:
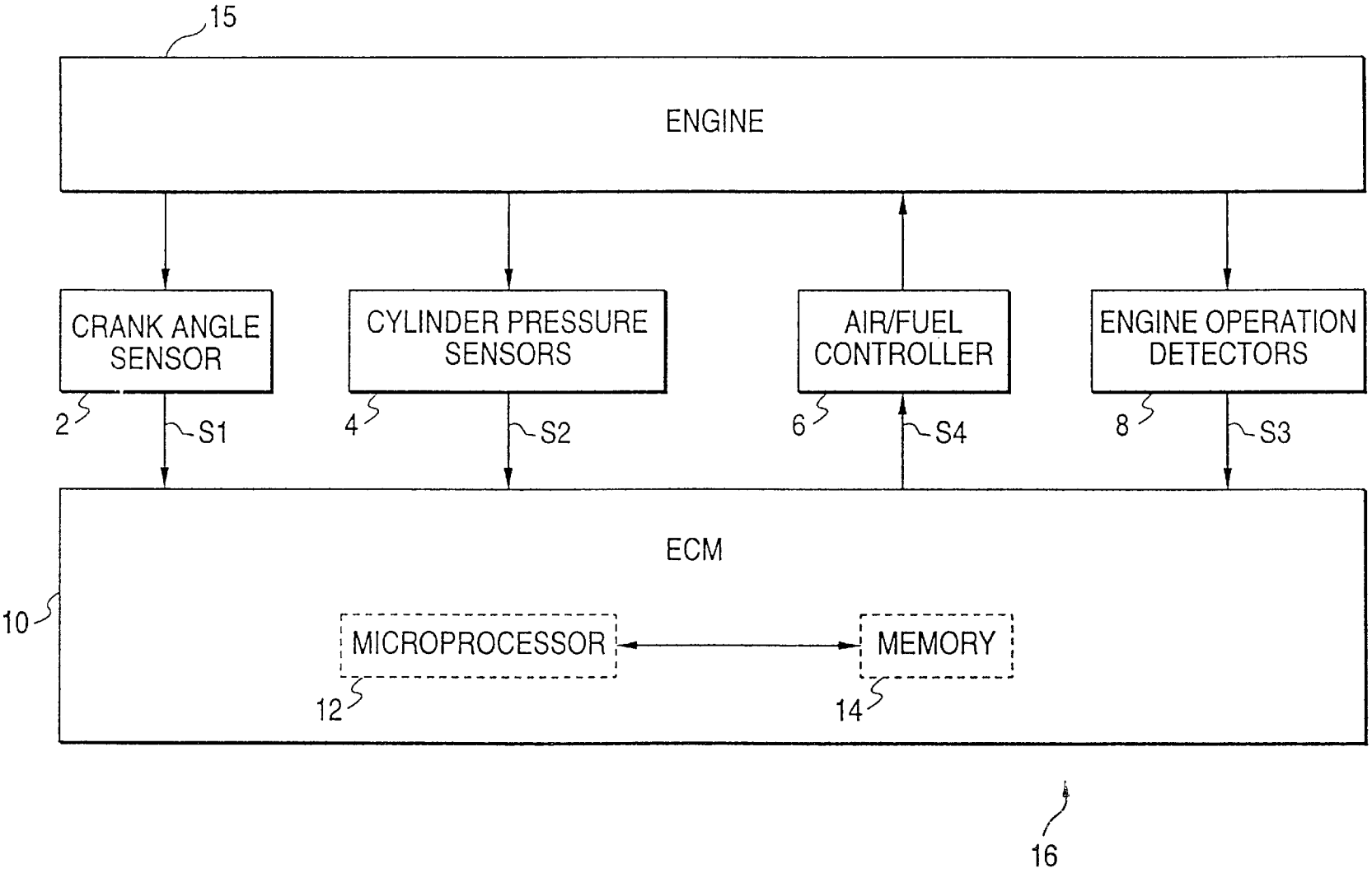
FIG. 1 is a block diagram of the air-fuel ratio control system of the present invention.

Referring now to FIG. 1, an air-fuel ratio control system in accordance with the present invention includes a crank angle sensor 2, at least one cylinder pressure sensor 4, an air-fuel controller 6, various sensors 8 for measuring the engine operating conditions, and an electronic control module (ECM) 10. While the present invention will be described as providing a sensor 2 for measuring cylinder pressures at specific crank angles, those skilled in the art of engine control appreciate that there are various other methods of sampling the cylinder pressure signal at a particular crank angle. The ECM 10 includes a microprocessor or microcontroller 12, while it is further understood to those skilled in the art of engine control that any similar processing unit may be utilized. The ECM also includes a memory or data storage unit 14, which contains a combination of ROM and RAM in the preferred embodiment of the present invention. The ECM 10 receives a crank angle signal S1 from the crank angle sensor 2, a cylinder pressure signal S2 from the cylinder pressure sensor 4, and engine operating condition signals S3 from the various engine sensors 8. The air-fuel controller 6 receives a control signal S4 for adjusting the air-fuel ratio in the engine 15.

Figure 2:
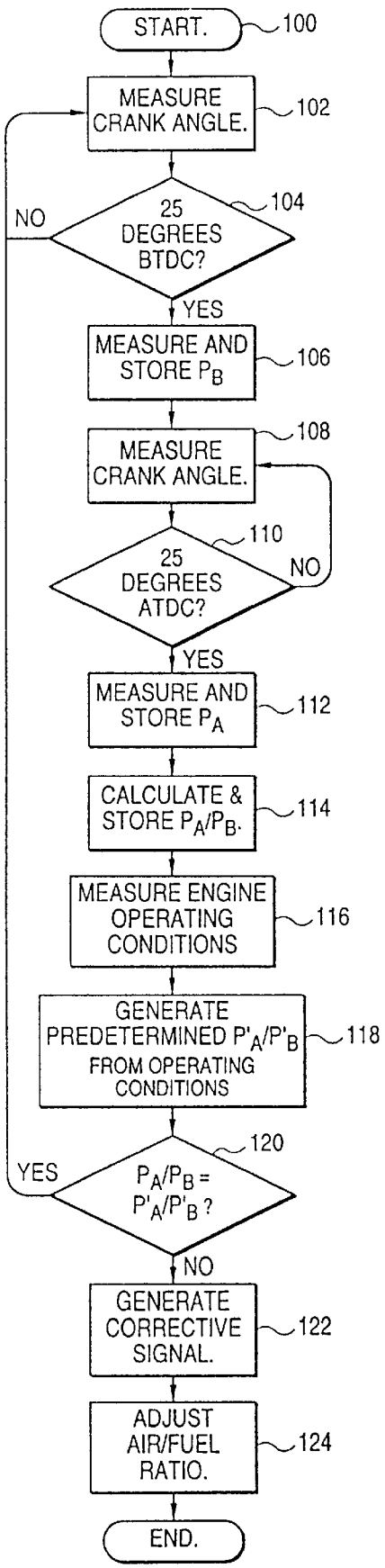
FIG. 2 is a flow chart of a control process to be executed by the air-fuel ratio control system of the present invention.

The control routine according to one embodiment of the present invention for controlling the air-fuel ratio of an internal combustion engine is shown in FIG. 2, wherein this routine is stored in the memory 14 of ECM 10 and executed by microprocessor 12. In block 102, the crank angle sensor 2 measures the crank angle of the crankshaft and generates an output signal S1 to the ECM 10 indicating the measured crank angle. In block 104, a query is made to determine if the crank angle is, for example, 25° before top dead center (BTDC). The importance of the specific crank angle selected is described here-in-below. When the response in block 104 is negative, control returns to block 102 of the routine and again measures the crank angle. When the response in block 104 is affirmative, control is transferred to block 106 to store the cylinder pressure $P_B$ measured by cylinder pressure sensor 4 in memory 14 as indicated by the signal S2 received by ECM 10 from the cylinder pressure sensor 4. The cylinder pressure signal may further be filtered, such as by using an analog filter, to remove noise present in the cylinder pressure signal. Those skilled in the art would understand that the steps undertaken in block 104 could be performed with an interrupt routine, where the routine is interrupted when a selected crank angle BTDC is reached and control is transferred to block 106.

After storing $P_B$, control transfers to block 108, where the crank angle sensor 2 again measures the crank angle of the cylinder crankshaft and generates an output signal S1 to the ECM 10 indicating the measured crank angle. In block 110, a query is made to determine if the crank angle is, for example, 25° after top dead center (ATDC). When the response to block 110 is negative, control returns to block 108 of the routine and again measures the crank angle. When the response in block 110 is affirmative, control shifts to block 112 to store the cylinder pressure $P_A$ measured by cylinder pressure sensor 4 in the memory 14 of ECM 10 as indicated by the signal S2 received by the ECM 10 from the cylinder pressure sensor 4. Again, an interrupt routine could alternatively be implemented in block 110 with control being transferred to block 112 when the selected angle ATDC is reached. In block 114, a measured cylinder pressure ratio $P_A/P_B$ is calculated and this ratio is stored in memory 14.

In block 116, the operating conditions of the engine are measured by the engine operation sensors 8, which output signals S3 to the ECM 10 indicative of such conditions. The engine operating conditions measured may include engine speed, engine load, boost, spark timing, throttle position, or any other condition which is indicative of how the engine is operating. In block 118, the measured operating conditions are used by the ECM 10 to look up a predetermined optimal pressure ratio $P_A'/P_B'$ from a cylinder pressure ratio information table stored in memory 14, wherein the optimal pressure ratio $P_A'/P_B'$ corresponds to the cylinder pressure ratio of an engine operating with a desired compromise between emissions, fuel economy, engine performance, engine durability, operating smoothness, etc. based upon the current operating conditions. In block 120, a query is made to determine if the measured pressure ratio $P_A/P_B$ equals the predetermined optimal pressure ratio $P_A'/P_B'$. When the response in block 120 is affirmative, the engine is properly functioning for that combustion cycle and control returns to block 100 to begin the routine for the next combustion cycle. When the response in block 120 is negative, control transfers to block 122 where the ECM 10 determines how the air-fuel ratio needs to be adjusted to modify the measured pressure ratio $P_A/P_B$ to equal the predetermined optimal pressure ratio $P_A'/P_B'$, and ECM 10 generates a control signal S4 informing air-fuel controller 6 how to modify the air-fuel ratio. In block 124, the air-fuel controller 6 adjusts at least one of the air and fuel to modify the air-fuel ratio accordingly. The air may be adjusted in any number of ways, such as controlling the throttle, controlling the wastegate on a turbocharger, or controlling a variable geometry turbocharger. The control routine for the specific combustion cycle is then complete, and control is then returned to step 100 to begin the control routine for the next combustion cycle. The control routine of FIG. 2 is continuously implemented over every combustion cycle of the engine.

The routine implemented by the ECM 10 adjusts the air-fuel ratio in order to achieve the optimal cylinder pressure ratio $P_A'/P_B'$, wherein the optimal cylinder pressure ratio $P_A'/P_B'$ is a function of engine speed, load, spark timing, temperatures, and other parameters that are available to the ECM 10. When the optimal pressure ratio $P_A'/P_B'$ is achieved within the cylinder, the engine is operating with the optimal compromise between emissions, fuel economy, engine performance, engine durability, and operating smoothness.

The above-described control routine precisely and accurately achieves the optimal air-fuel ratio for the sensed engine operating conditions when operating under lean air-fuel mixtures. This accurate control is achieved by utilizing the predetermined relationship between the cylinder pressure ratio $P_A'/P_B'$ and the lean air-fuel ratio. Therefore, for each lean air-fuel ratio there is a corresponding cylinder pressure ratio $P_A'/P_B'$. However, the relationship between the air-fuel ratio and the cylinder pressure is such that when air-fuel mixtures are used which are richer than the stoichiometric air-fuel ratio, the measured cylinder pressure ratio $P_A/P_B$ can be similar to values of the cylinder pressure ratio $P_A'/P_B'$ corresponding to lean air-fuel ratios. Unless the control routine is aware that the air-fuel mixture is rich, a measured cylinder pressure ratio $P_A/P_B$ for a rich air-fuel mixture could be mistaken for the similar predetermined cylinder pressure ratio $P_A'/P_B'$ corresponding to a lean air-fuel mixture, and the control routine could incorrectly add more fuel to the already rich air-fuel mixture thinking the air-fuel mixture is lean. Therefore, in order to ensure that the measured cylinder pressure ratio $P_A/P_B$ is not inadvertently used for an air-fuel ratio which is richer than stoichiometric, a stoichiometric EGO sensor could be used in conjunction with the present invention to simply determine if the air-fuel ratio is rich. If the stoichiometric EGO sensor determines a rich air-fuel ratio is present, the control routine would not confuse the measured cylinder pressure ratio $P_A/P_B$ with similar values of the cylinder pressure ratio $P_A'/P_B'$ corresponding to lean air-fuel ratios.

A cylinder pressure sensor 4 may be positioned in more than one of the cylinders or all of the cylinders to monitor the cylinder to cylinder variation in pressure ratio. By examining the cylinder to cylinder variability in the pressure ratio, the air-fuel ratio and engine control system 16 can detect cylinders which are not performing as well as the remaining cylinders. Therefore, the measured pressure ratio $P_A/P_B$ provides a simply and efficient manner of detecting and troubleshooting errors occurring within the cylinders of the engine. While the engine is designed to achieve substantially the same combustion event in each cylinder for a given set of engine conditions, in actuality, the combustion event within each cylinder will vary from cylinder to cylinder due to manufacturing tolerances and deterioration-induced structural and functional differences between components associated with the cylinders. Therefore, by monitoring the variability in the pressure ratio in the individual cylinders, the engine control system 16 can separately adjust the air-fuel ratio within the different cylinders to balance the performance of the individual cylinders. Similarly, by comparing the pressure ratios of the individual cylinders and their variations to the predetermined target pressure ratios, the engine control system 16 of the present invention can detect poorly functioning or deteriorating components. For example, the measured cylinder pressure ratio $P_A/P_B$ can be used to detect misfires or partial burns in the cylinders. Misfires usually occur if the air-fuel ratio is operating too lean to properly combustor if there is a problem with the ignition system in providing a satisfactory spark. Accordingly, one advantage provided by detecting misfires is the indication that the air-fuel ratio is most-likely operating too lean, so the engine control system 16 would know that air-fuel ratio is too lean and more fuel needs to be added to the mixture.

In an alterative use of the present invention, the air-fuel ratio control system 16 may simply monitor the measured pressure ratio $P_A/P_B$ to detect misfires in order to operate as close to the lean limit as possible. Using this method, the air-fuel ratio is gradually made leaner until a misfire is detected by the air-fuel ratio control system 16. Once a misfire is detected, the air-fuel ratio control system 16 knows that the engine is operating with too lean of an air-fuel mixture and more fuel is simply added to the air-fuel mixture until no further misfires are detected. By monitoring the measured pressure ratio $P_A/P_B$ to detect misfires, a simple and efficient method of operating near the lean limit for the air-fuel ratio is achieved. It is often desirable to operate an engine as close the lean limit of the air-fuel ratio as possible in order to minimize $NO_X$ emissions as much as possible.

Figure 3:
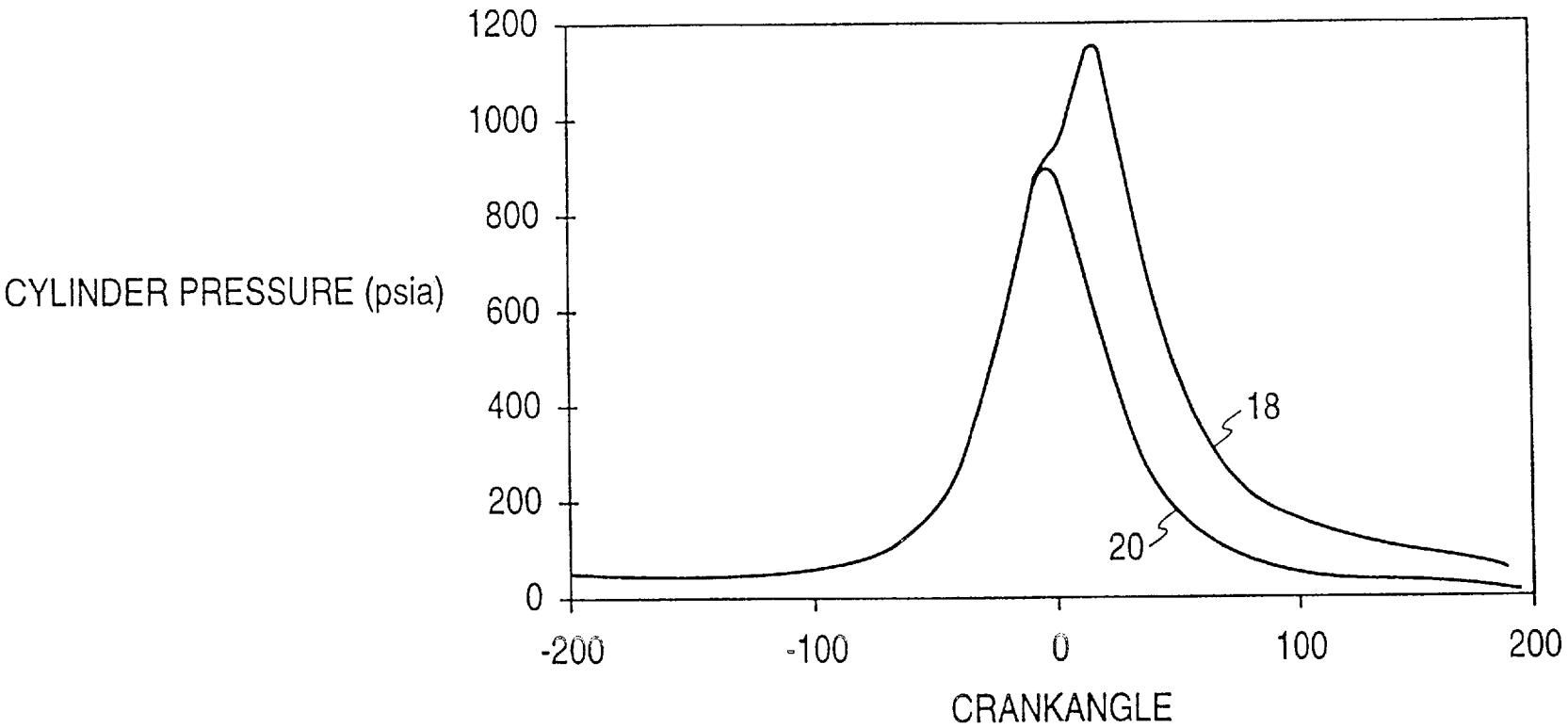
FIG. 3 is a graphical representation of the cylinder pressure as a function of crank angle during a combustion cycle in the engine for a selected engine operating condition.

FIG. 3 is a graphic representation of cylinder pressure as a function of crank angle for a single combustion cycle, where curve 18 shows the cylinder pressure response for a normal combustion event and curve 20 shows the cylinder pressure response when there is a misfire. Each point in the graph of FIG. 3 represents an average value over 100 engine cycles. As can be seen from curve 20, when there is a misfire, the cylinder pressure is essentially symmetrical about TDC. This symmetrical relationship results in the measured pressure ratio $P_A/P_B$ measured for a specific angle before and after TDC to be approximately equal to 1. However, as can be seen from curve 18, a normal combustion event will not produce a symmetrical cylinder pressure about TDC, resulting in the measured pressure ratio $P_A/P_B$ for a specific angle before and after TDC to not equal 1. Therefore, the present invention provides a simple procedure for detecting misfires by examining the resulting value of the measured cylinder pressure ratio $P_A/P_B$, and, thus, a simple and efficient manner of detecting errors in the combustion process is achieved. Partial burns can also be easily detected with the measured pressure ratio $P_A/P_B$, since a partial burn will retard the combustion event and lower the measured pressure ratio $P_A/P_B$.

The measured cylinder pressure ratio $P_A/P_B$ of the present invention can also be used to determine other key parameters, such as the location of the centroid of combustion, the effective expansion ratio, and the start of the combustion event, using a predetermined correlation between the cylinder pressure ratio $P_A/P_B$ and the parameter to be determined. The centroid of combustion correlates with the pressure ratio and functional dependence between these two elements can be determined, since the measured pressure ratio $P_A/P_B$ decreases as the centroid of heat release is retarded. The expansion ratio is the ratio of the cylinder volume at BDC to the cylinder volume at a particular crank angle, and an expansion ratio for each crank angle at which combustion occurs can be computed. The effective expansion ratio is determined by calculating an average expansion ratio during combustion by weighting the expansion ratio at each crank angle at which combustion occurs by the amount of heat released at that crank angle. The functional relationship between the heat release rate and the measured pressure ratio $P_A/P_B$ allows a functional relationship also to be determined between the measured pressure ratio $P_A/P_B$ and the effective expansion ratio.

Although the process as described above uses the measured cylinder pressure ratio $P_A/P_B$ from each combustion cycle to adjust the air-fuel ratio for the next cycle, the process may also be slightly modified to use an average value of the measured cylinder pressure ratio $P_A/P_B$ over a number of combustion cycles before the air-fuel ratio is adjusted. The modified process includes a loop starting after block 114 where $P_A/P_B$ is calculated, so that control in the modified process returns back to block 100 to measure the cylinder pressures $P_A$ and $P_B$ over the next combustion cycle. This loop is duplicated for the desired number of combustion cycles, and the average measured cylinder pressure ratio $P_A/P_B$ over these combustion cycles is used as the value of $P_A/P_B$ for the rest of the process. By using the average cylinder pressure ratio over a number of combustion cycles, the air-ratio control system 16 does not need to respond abruptly and unnecessarily to change the air-fuel ratio on the basis of one extraordinary or anomalous measured cylinder pressure ratio $P_A/P_B$. This allows for a smoother and more gradual adjustment of the air-fuel ratio when necessary. The number of cycles used for the average value of the measured cylinder pressure ratio $P_A/P_B$ should be at least as many to prevent unnecessary abrupt changes in the air-fuel ratio but should not be too many cycles that the response time is not quick enough to keep the engine operating optimally. Using an average value of the measured cylinder pressure ratio $P_A/P_B$ over a plurality of cycles serves to filter the measured cylinder pressure ratio $P_A/P_B$ over time, and there exists numerous other different methods of filtering known to those skilled in the art which could be similarly be implemented in the present invention to achieve filtering or smoothing of the measured cylinder pressure ratio $P_A/P_B$ over time.

In addition to controlling the air-fuel ratio, the control process may alternatively be implemented in an engine control system in which the control process is strictly used to fine tune the operation of the engine by adjusting the air-fuel ratio, where the initial setting of the air-fuel ratio is not implemented using this control process. This alternative use of the control process is particularly useful where a rapid adjustment of the air-fuel ratio is desired. When the engine is experiencing a series of rapidly changing operating conditions, a feedback control loop as implemented by the above-described control process may not provide the immediate adjustments to alter the air-fuel ratio which may be necessary to adapt to the rapidly changing engine operating conditions. Therefore, the engine control system 16 may look at certain engine operating conditions, such as throttle position or boost, to provide an estimated air-fuel ratio for the cylinders prior to the implementation of the control process described above. The control process would, in this situation, serve more to fine tune the air-fuel ratio to obtain the optimal operating conditions after the estimated air-fuel ratio value already has approximated the optimal operating conditions.

As described above, when the engine is experiencing a transient period of rapidly changing operating conditions, such as the engine accelerating from idle, the control routine may not provide for adjustment of the air-fuel ratio within a sufficient response time. However, while it is difficult for the control algorithm to respond to rapidly changing operating conditions, the control algorithm can easily determine the discrepancy between how the air-fuel ratio should have been controlled to operate optimally with the transient operating conditions and how the air-fuel ratio actually was controlled by monitoring the quality of combustion as described above. By monitoring these discrepancies, the air-fuel ratio control system 16 can learn how the air-fuel ratio should be controlled to when later experiencing similar transient operating conditions. Therefore, an alternative embodiment of the air-fuel ratio control system 16 of the present invention may include the capability of monitoring the quality of combustion during transient operating conditions and storing the discrepancy between how the air-fuel ratio should have been controlled to operate optimally with the transient operating conditions. The air-fuel ratio control system 16 may then learn from previous transient operating conditions to detect the amount that the controlled air-fuel ratio deviated from its optimal value, and in subsequent similar transient operating conditions the air-fuel ratio control system 16 can estimate the air-fuel ratio to reduce the amount of deviation from the optimal air-fuel ratio for the transient operating conditions being experienced by the engine. Therefore, using hindsight, the air-fuel ratio control system 16 can detect if there was too much or too little fuel in the air-fuel mixture for a transient operating conditions experienced. Then the air-fuel ratio control system can learn from this and know whether to add more or less fuel to the air-fuel ratio when experiencing similar load conditions. Over time, the air-fuel ratio control system 16 will focus in on the precise air-fuel ratio the engine should be operating at for a given transient condition and will be able to estimate this air-fuel ratio when sensing this transient condition. This learning algorithm implemented by the air-fuel ratio control system 16 allows the engine to more closely achieve the desired combustion quality on subsequent transient operating conditions which are similar to past transient operating conditions.

Figure 4:
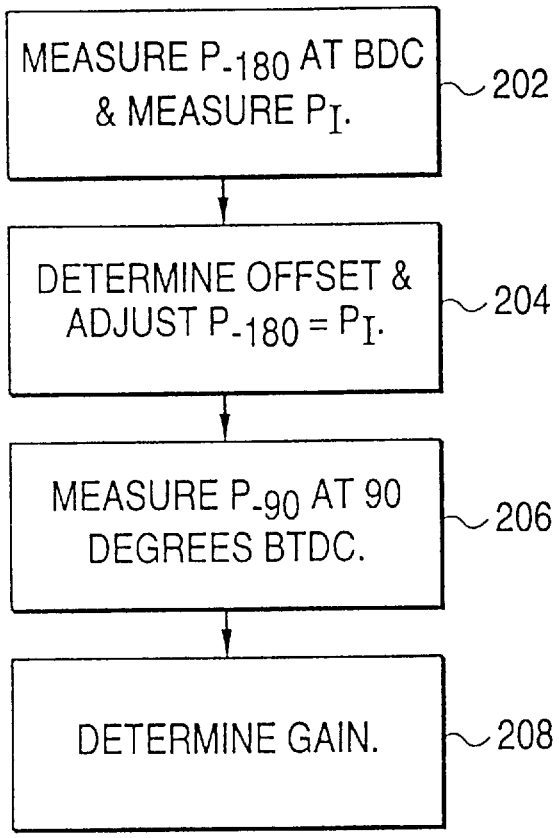
FIG. 4 is a flow chart of a control process calculating the amount of offset and gain of the cylinder pressure sensor to be executed by the air-fuel ratio control system of the present invention prior to the control program of FIG. 1.

In order to ensure that the pressure measurements taken by cylinder pressure sensors 4 are accurate and consistent with the values stored in the cylinder pressure information look-up table, the amount of offset and gain of the cylinder pressure sensors 4 can also be calculated during the compression stroke in the combustion event. Referring now to FIG. 4, the control process for determining the offset and gain of the cylinder pressure sensors 4 is shown, wherein this process is stored in the memory 14 of ECM 10 and executed by microprocessor 12. In block 202, the cylinder pressure sensor 4 measures the cylinder pressure $P_{-180}$ at BDC (180° before TDC) and stores this value in the memory 14 of ECM 10 as indicated by the signal S2 received by the ECM 10 from the cylinder pressure sensor 4. Additionally, the intake manifold pressure $P_I$ is measured by a pressure sensor 8 and this value is stored in the memory 14 of ECM 10 as indicated by the signal S4 received by the ECM 10 from the intake manifold pressure sensor 8. In block 204, the cylinder pressure $P_{-180}$ and the intake manifold pressure $P_I$ are compared to determine the amount of offset between the two pressures. The amount of offset is determined by the following equations:

$$P_{-180} = V_{-180} \times \text{Gain} + \text{Offset}$$

$$P_{-180} = P_I$$

$$\text{Offset} = P_I - (V_{-180} \times \text{Gain})$$

After determining the amount of offset, the ECM 10 adjusts the offset of the cylinder pressure sensor 4 to make the cylinder pressure at BDC equal to the intake manifold pressure by adding the necessary offset to the measured cylinder pressure values. Forcing the measured BDC in-cylinder pressure to equal the measured intake manifold pressure $P_I$ at BDC is referred to as pegging. Pegging is often necessary because typical in-cylinder pressure sensors 4 are not capable of D.C. (direct current) measurements, since typical in-cylinder pressure sensors 4 are only capable of measuring a change in pressure and are not capable of measuring an absolute pressure.

The routine then moves on to block 206, where the cylinder pressure sensor 4 measures the cylinder pressure $P_{-90}$ at 90° BTDC and provides a voltage signal $V_{-90}$ corresponding to the cylinder pressure at 90° BTDC, wherein this value is stored in the memory 14 of ECM 10 as indicated by the signal S2 received by the ECM 10 from the cylinder pressure sensor 4. In block 208, the ECM 10 calculates the gain of the cylinder pressure sensor using the equations below:

$$P_{-90}=(V_{-90}\times\text{Gain})+\text{Offset}$$

The gain is then determined using a value for $P_{-90}$ obtained from the polytropic compression of the charge air in the combustion cylinder, which is defined by the equation:

$$\left(\frac{P_{-90}}{P_{-180}}\right)=\left(\frac{\text{Volume}_{-90}}{\text{Volume}_{-180}}\right)^{-K}$$

where $P_{-180}$ is the pressure at 180° BTDC which has been set to equal the absolute intake manifold pressure through pegging. The $\text{Volume}_X$ is the total volume of the combustion chamber at the angle X; for example, $\text{Volume}_{-90}$ is the volume of the combustion chamber at 90° BTDC. K is the polytropic compression coefficient, where K typically ranges in value between 1.1–1.4 depending upon several parameters, such as engine speed, temperature, and engine size. However, since K does not vary greatly, it is possible to choose a value for K with the range of 1.1 to 1.4 which most closely corresponds to the engine being utilized. The value for $P_{-90}$ is then used in the gain equation to determine the gain of the cylinder pressure sensor, where $$\text{Gain} = \frac{\left(\frac{\text{Volume}_{-90}}{\text{Volume}_{-180}}\right)^{-K} \times P_{-180} - \text{Offset}}{V_{-90}}$$

Once the gain of the cylinder pressure sensor is determined it can be used to calculate measured pressures $P_A$ and $P_B$ by adjusting future cylinder pressure measurements corresponding to the voltage sensed at the predetermined angle before TDC and after TDC in conjunction with the offset of the cylinder pressure sensor. For example, a measured cylinder pressure can be calculated using the following gain equation:

$$P_X=[V_X\times\text{Gain}]+\text{Offset}$$

where X is the angle at which the cylinder pressure is measured and $P_X$ represents the voltage sensed by the cylinder pressure sensor at an angle of X°. It is understood to those skilled in the art that it is not necessary to convert the measured voltages to pressures before performing all of the above calculations. While the above routine describes determining the gain and offset of the cylinder pressure sensor by taking pressure measurements at 180° and 90° BTDC, it is also understood by those skilled in the art that pressure measurements may be taken at other similar angles BTDC when determining the gain and offset of the cylinder pressure sensor.

Lean Burn Air-Fuel Ratio Control

Operating an engine with a lean mixture provides numerous advantages such as lowering $NO_X$ emissions, increasing the efficiency of the engine, increasing durability, and providing a greater knock margin. When operating lean, it is very important that the air-fuel ratio be precisely controlled. If the air-fuel mixture is too lean then the engine will run rough and produce insufficient power. Further, if the air-fuel mixture is too rich, then excessively high $NO_X$ emissions are likely to occur. Also, if the air-fuel mixture is too rich, then knocking may occur which is destructive to the engine and excessively high engine temperatures may also result. It is therefore imperative to accurately control the air-fuel ratio when operating under lean burn conditions.

However, the performance of an engine should not be measured by the air-fuel ratio, but rather by the excess air ratio (also referred to as Lambda, λ). Lambda is defined as:

$$\lambda=(\text{Air-Fuel Ratio})/(\text{Air-Fuel Ratio@ stoichiometric conditions}),$$

wherein the air-fuel ratio is the mass flow of the air divided by the mass flow of the fuel currently being delivered to the engine, and the air-fuel ratio at stoichiometric conditions is exactly the right amount of air (oxygen in the air) to convert all of the fuel molecules to $CO_2$ and $H_2O$. Engine performance is sensitive to Lambda and not the air-fuel ratio, even though Lambda is indirectly controlled by the amount of air and/or fuel introduced into the engine. This principle governs the present invention, because for two different blends or qualities of fuel, the engine will operate substantially the same if the engine is operating at the same Lambda for both fuels. However, the air-fuel ratio for the two different blends of fuel will not necessarily be the same when operating at the same Lambda. Therefore, it is imperative to monitor Lambda and not the air-fuel ratio for each combustion event in order to monitor the quality of combustion. For situations where low fuel qualities are used, i.e. fuels with very low BTU content (fuels with very low heating values), even if Lambda is the same for the different fuels, the combustion quality could deteriorate with the low quality fuel. The present invention compensates for the low quality of fuel by measuring the quality of combustion rather than the quality of the fuel, wherein the characteristics of low quality fuels are difficult to measure using existing EGO sensors.

As stated above, it is imperative to accurately control the excess air ratio when operating under lean burn conditions. Since Lambda is a function of the air-fuel ratio and Lambda reveals the performance of the engine, it is necessary to precisely control Lambda under lean burn conditions. The engine operates too lean when Lambda is too high, and the air-fuel mixture is too rich with fuel when Lambda is too low. In current engine control systems, in order to calculate Lambda it is typically necessary to measure or estimate the amount of air and fuel delivered to the engine to calculate the air-fuel ratio. Furthermore, in order to determine the stoichiometric air-fuel ratio, existing technology uses an exhaust gas oxygen (EGO) sensor to measure the oxygen concentration in the exhaust leaving the combustion chamber. However, when operating very lean (Lambda>1.6), existing EGO sensors cannot accurately measure the exhaust oxygen concentration, which results in an inaccurate determination of Lambda. Therefore, Lambda cannot accurately be determined or precisely controlled using existing EGO sensors. Currently, the biggest disadvantage of operating lean is that the engine is extremely sensitive to small errors in Lambda, and it is difficult to accurately achieve the desired Lambda.

The present invention utilizes the measured cylinder pressure ratio $P_A/P_B$ to accurately determine and control Lambda. The measured cylinder pressure ratio $P_A/P_B$ is extremely sensitive to small changes in Lambda. Therefore, under lean bum conditions, the measured pressure ratio $P_A/P_B$ is extremely useful in determining the combustion quality of the engine by determining Lambda. During lean operation, increasing Lambda slows the heat release rate (the rate at which the fuel is burning) and shifts the timing of the heat release to later crank angles. The effects of increasing Lambda in this manner decreases the measured pressure ratio $P_A/P_B$. Thus, as Lambda is changed, there is a change in the combustion process which directly affects the cylinder pressure and pressure ratio.

Figure 5B:
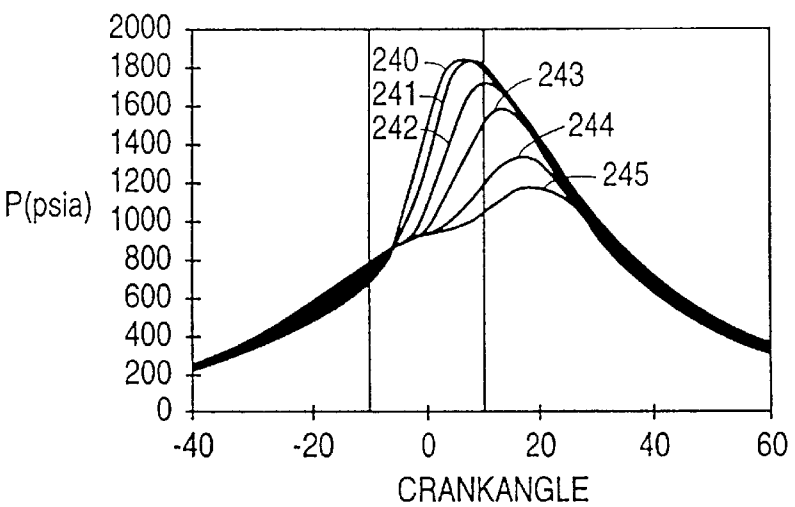
FIG. 5(*a*) is a graphical representation of the apparent heat release during combustion for different excess air ratios as a function of crank angle for a selected engine operating condition.
Figure 5A:
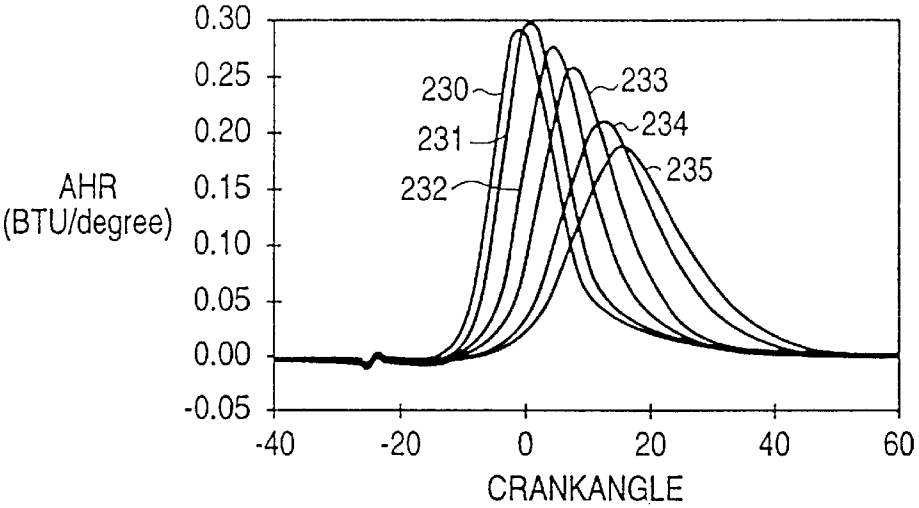

These changes in the combustion process associated with changes in Lambda are shown in FIGS. 5(*a*) and (*b*). FIG. 5(*a*) illustrates the apparent heat release (AHR) during combustion as a function of crank angle for different Lambdas at a constant fuel flow rate, a constant ignition timing, and an engine speed of 1800 rpm, where each point in the graph represents an average value over 100 engine cycles. As can be seen from FIG. 5(*a*), the apparent heat release rate is slowed and retarded to later crank angles as Lambda increases. Curves 230, 231, 232, 233, 234 and 235 represent Lambda values of 1.4, 1.5, 1.61, 1.7, 1.75 and 1.78, respectively. FIG. 5(*b*) illustrates the cylinder pressure as a function of crank angle for different Lambdas at a constant fuel flow rate, a constant ignition timing, and an engine speed of 1800 rpm. Curves 240, 241, 242, 243, 244 and 245 represent Lambda values of 1.4, 1.5, 1.61, 1.7, 1.75 and 1.78, respectively. As can be seen from FIG. 5(*b*), the cylinder pressure decreases as Lambda is increased, resulting in decreased values for the measured pressure ratio $P_A/P_B$ as Lambda increases.

Figure 6:
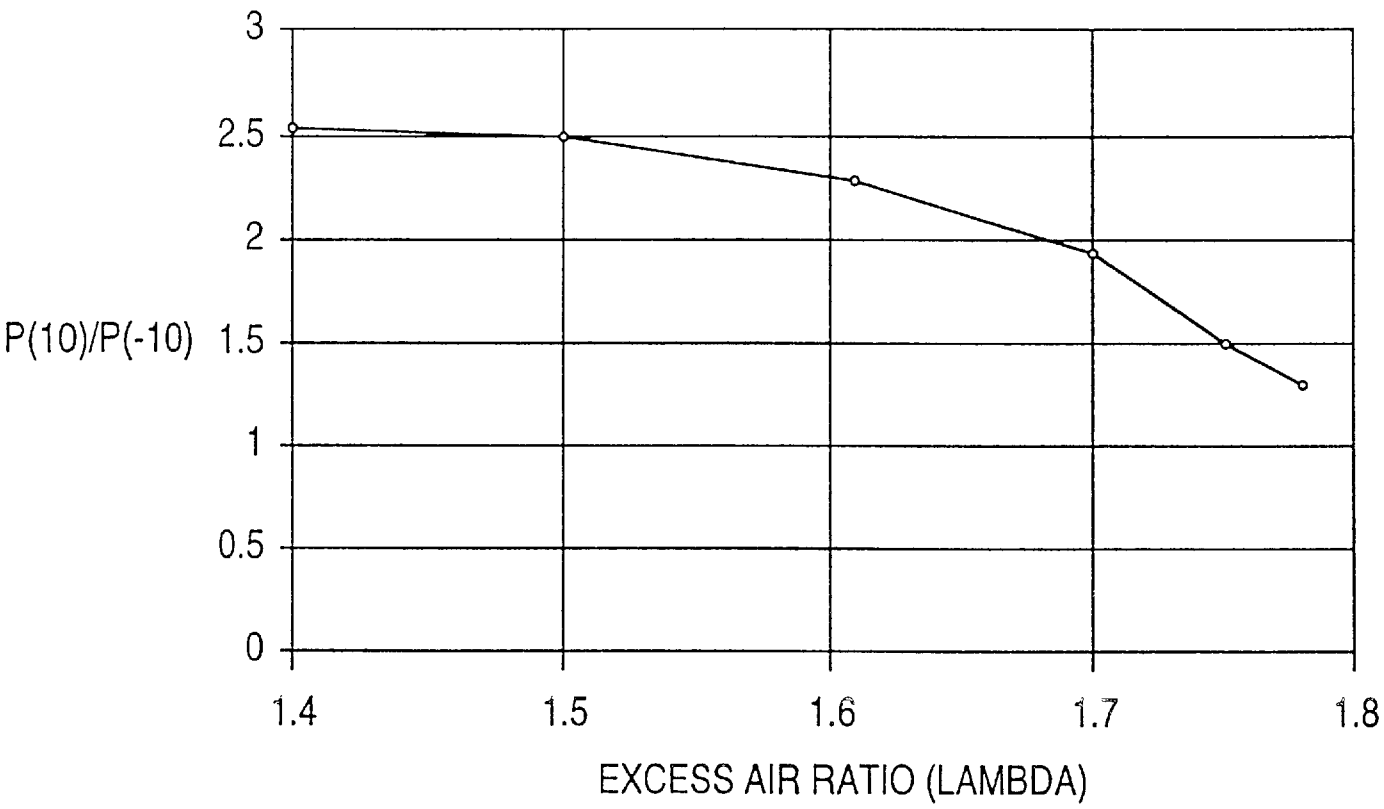
FIG. 6 is a graphical representation of the cylinder pressure ratio measured at 10° around TDC as a function of excess air ratios for a selected engine operating condition.

Therefore, increasing Lambda produces two effects which reinforce one another. First, as Lambda is increased the heat release is retarded and slowed, which decreases the pressure ratio as shown above. Secondly, as Lambda is increased, less heat is released per mass of charge since there is less fuel energy available per mass of charge, which also decreases the pressure ratio. Accordingly, these two reinforcing effects result in large changes in the measured pressure ratio $P_A/P_B$ for small changes in Lambda at lean conditions, making the present invention a very effective manner of controlling the air-fuel ratio at lean conditions. As can be seen from FIG. 6, where the measured cylinder pressure ratio $P_A/P_B$ taken at 10° around TDC is shown as a function of Lambda for an engine operating at 1800 rpm, there is a greater change in the measured pressure ratio $P_A/P_B$ as Lambda becomes leaner ($1.5<\lambda<1.8$), wherein each point in the graph represents an average value over 100 engine cycles.

Figure 7:
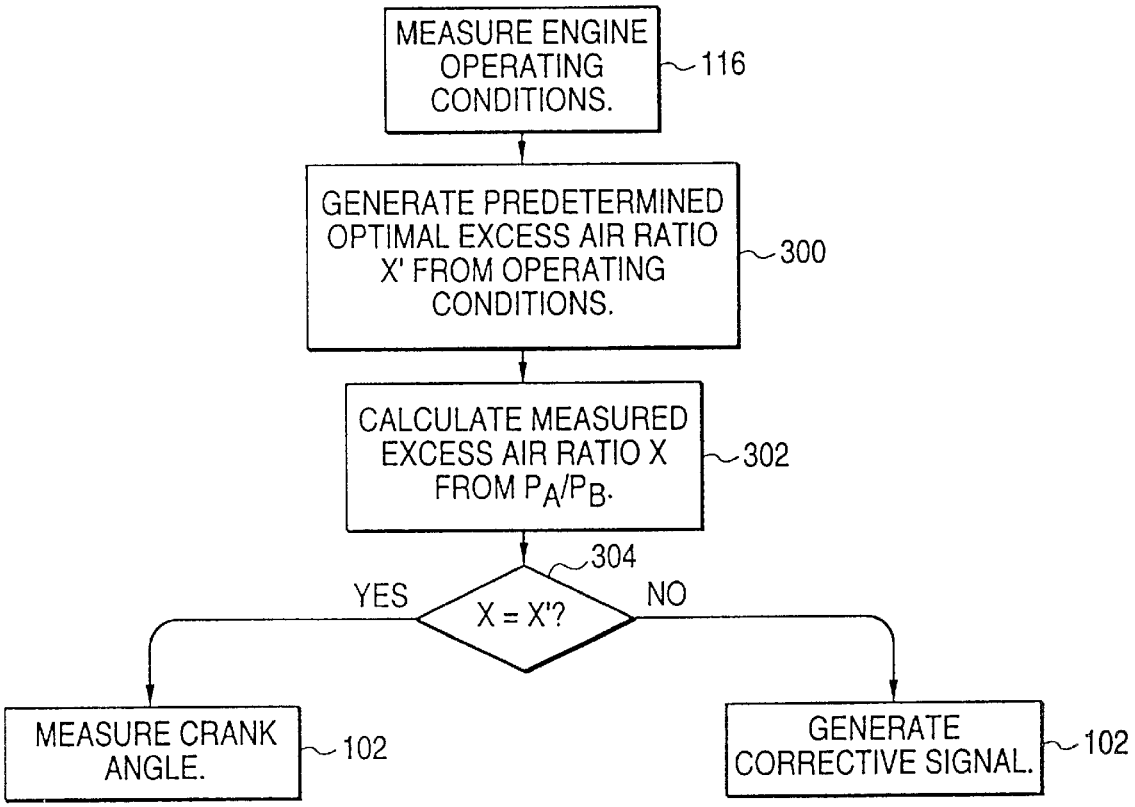
FIG. 7 is a flow chart of a control process using the excess air ratio of the engine to control the air-fuel ratio in accordance with an alternative embodiment of the air-fuel ratio control system of the present invention.

Referring now to FIG. 7, a second embodiment of the air-fuel ratio and engine control system 16 of the present invention is illustrated, wherein this embodiment uses the measured pressure ratio $P_A/P_B$ to measure and control Lambda. Lambda is measured and controlled using a slightly modified version of the control process described above in conjunction with FIG. 2, wherein blocks 300–304 in FIG. 7 replace blocks 118 and 120 in the main control process of FIG. 2. All of the other blocks of the main control process of FIG. 2 are followed by the Lambda control process, unless expressly described otherwise. After the ratio $P_A/P_B$ is calculated and stored in memory 14 in block 114, the operating conditions of the engine are measured by the engine operation sensors 8 in block 116. In block 300, the measured operating conditions are used by the ECM 10 to look up a predetermined optimal excess air ratio or Lambda, X', which corresponds to the current operating conditions as stored in a cylinder excess air ratio information table stored in memory 14. In block 302, the measured pressure ratio $P_A/P_B$ is used to determine a measured excess air ratio, X, at which the cylinder is currently operating, wherein the measured excess air ratio is a function of the measured pressure ratio $P_A/P_B$ as stored in an information table located in memory 14. In block 304, a query is made to determine if the measured excess air ratio X equals the predetermined optimal excess air ratio X'. The optimal excess air ratio X' is a function of engine speed, load, spark timing, temperatures, and other parameters that are available to the ECM 10. The engine is operating with the optimal compromise between emissions, fuel economy, engine performance, engine durability, and operating smoothness when the optimal excess air ratio X' is achieved within the cylinder. When the response in block 304 is affirmative, then the engine is properly functioning for that combustion cycle and control returns to block 102 to measure the crank angle for the next combustion cycle. When the response in block 304 is negative, control is transferred to block 122 where the ECM 10 determines how the air-fuel ratio needs to be adjusted to modify the excess air ratio X to equal the predetermined optimal pressure ratio X', and ECM 10 generates a control signal S4 informing air-fuel controller 6 how to modify the air-fuel ratio. In block 124, the air-fuel controller 6 adjusts either the air, the fuel, or both the air and fuel, to modify the air-fuel ratio accordingly.

The control process in accordance with the present invention measures the cylinder pressures $P_A$ and $P_B$ at an angle in the range of approximately 10°–30° before TDC and approximately 10°–30° after TDC. In the preferred embodiment of the present invention, $P_A$ is measured at the same angle after TDC as the angle $P_B$ is measured before TDC in order to reliably monitor the combustion event. The measured pressure ratio $P_A/P_B$ is extremely sensitive to small changes in Lambda when the cylinder pressures are measured at an angle in the range of 10°–30°. Since a main object of the present invention is to precisely measure and control Lambda for each cylinder using the measured pressure ratio $P_A/P_B$, it is desirable that the cylinder pressure measurements be taken in the range of 10°–30° where the measured pressure ratio $P_A/P_B$ is most sensitive to minute changes in Lambda.

Figure 8:
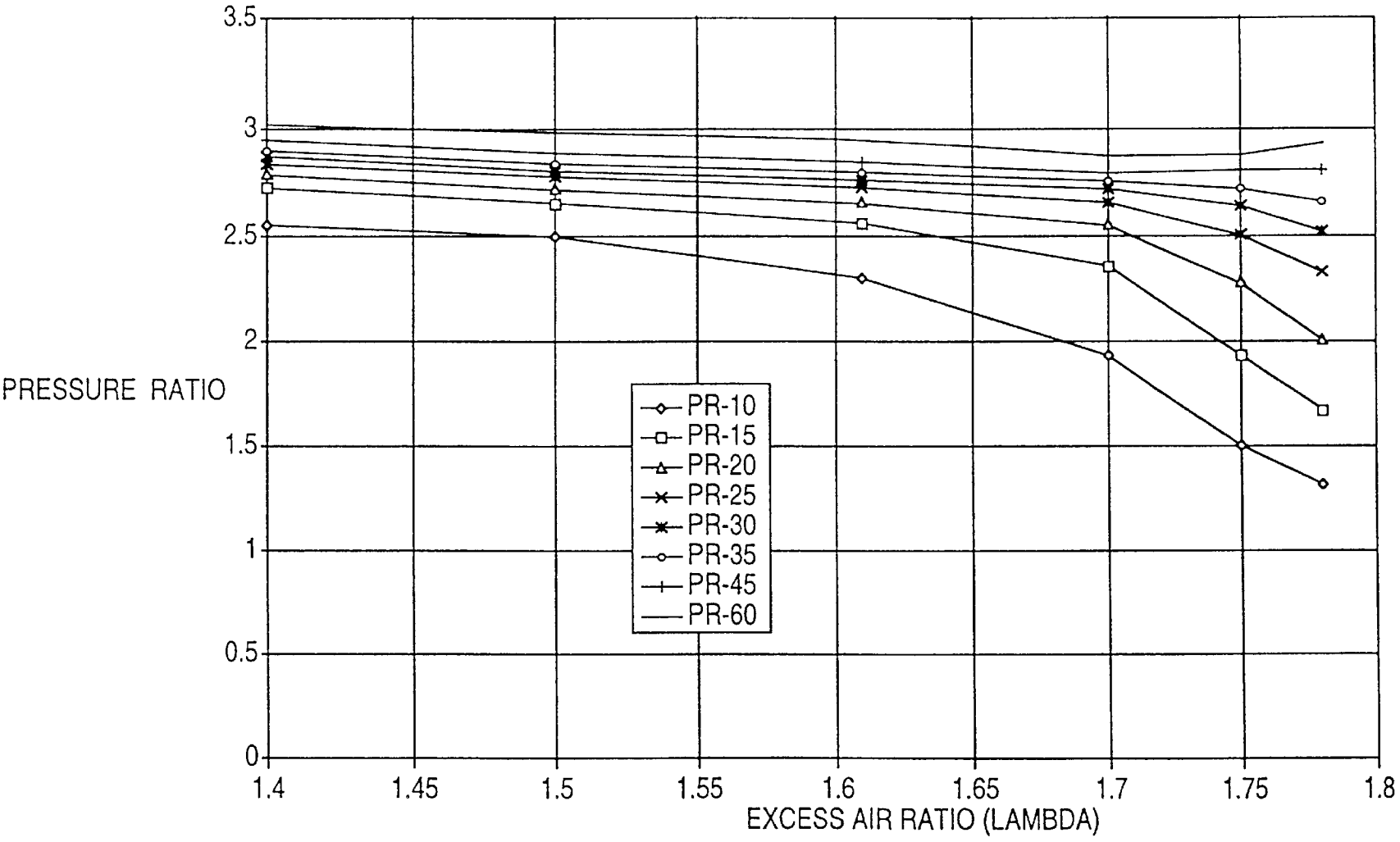
FIG. 8 is a graphical representation of the cylinder pressure ratio for different angles around TDC as a function of excess air ratios for a selected engine operating condition.

Referring now to FIG. 8, the measured pressure ratio $P_A/P_B$ is plotted as a function of Lambda for a range of crank angles between 10°–60° for the specific test engine used, where each point in the graph represents an average value over 100 engine cycles. As can be seen from FIG. 8, for the measured pressure ratios $P_A/P_B$ measured at crank angles of 35°, 45°, and 60°, there is very little change in the measured pressure ratio $P_A/P_B$ with changes in Lambda. However, there is substantial change in the pressure ratio $P_A/P_B$ with changes in Lambda for crank angles between 10°–30°, especially between 15°–25°. In order to precisely calculate Lambda for each pressure ratio $P_A/P_B$, it is necessary for changes in the pressure ratio $P_A/P_B$ to be evident from even small changes in Lambda. Therefore, the air-fuel ratio control system 16 according to the present invention cannot accurately function at crank angles greater than 30° for this particular engine, since there are not substantial changes in the pressure ratio $P_A/P_B$ with changes in Lambda at these crank angles. When the measured crank angles are too far apart, a third effect results which actually competes with the two reinforcing effects resulting from increasing Lambda discussed above. First, as Lambda is increased, less fuel is available per mass of charge, which tends to decrease the pressure ratio. Second, as Lambda is increased, the heat release is retarded, which reduces the efficiency of the engine. This results in less work being produced and, therefore, less energy is extracted from the gases. The end result of retarded combustion is that less energy is extracted from the fuel, increasing the pressure at the end of combustion, and thus increasing the pressure ratio. As one effect decreases the pressure ratio the other effect increases the pressure ratio, and these effects cancel each other out resulting in little change in the pressure ratio when the crank angles are too far apart. Furthermore, crank angles much smaller than 10° cannot be used to effectively calculate Lambda, because when the crank angles are too close together, for instance at +/−2 degrees around TDC, the pressures $P_A$ and $P_B$ will be very close and small changes in Lambda will not significantly affect the measured pressure ratio $P_A/P_B$.

It may be advantageous for the control system to use different crank angles for the calculation of the pressure ratio $P_A/P_B$ based on the engine operating conditions. For instance, when the engine is operating under conditions with a retarded spark timing, it may be advantageous to use crank angles of +/−25 degrees around TDC when taking the pressure measurements $P_A$ and $P_B$; whereas when the engine is operating under conditions with an advanced spark timing, it may be more advantageous to use crank angles of +/−15 degrees when taking the pressure measurements $P_A$ and $P_B$. Since changing the crank angle at which the cylinder pressure measurements $P_A$ and $P_B$ are taken in turn affects the pressure ratio $P_A/P_B$, a different target pressure ratio $P_A'/P_B'$ is required at different crank angles. It also may be desirable to vary the crank angle at which the cylinder pressure measurements $P_A$ and $P_B$ are taken in order to avoid possible electrical interference from the spark discharge in the cylinder.

By using the air-fuel ratio and engine control system 16 according to the present invention, the engine will function similarly when using different qualities or blends of fuel. This occurs because the engine control system 16 is using the measured pressure ratio $P_A/P_B$ and Lambda to monitor the quality of combustion. Therefore, the engine control system looks at the end result of the combustion event to ensure that the engine is operating properly for the present conditions, and the engine control system 16 does focus upon how the cylinder input and output variables are functioning. The engine control system 16 examines the combustion quality to determine if the right amount of fuel was delivered to the engine, rather than measuring the fuel input into or output from the cylinder. This feature is particularly important when using natural gas as a fuel, because it is extremely difficult to accurately deliver exactly the right amount of natural gas into the cylinder. Furthermore, all blends of fuel, especially natural gas, are not identical, so just by measuring the fuel input into the cylinder is not a true test of whether the correct amount of fuel for that specific blend was used. Additionally, outside of a laboratory environment, it is very difficult to accurately determine the stoichiometric air-fuel ratio of a natural gas using sensors mounted within an engine. The stoichiometric air-fuel ratio of a natural gas fluctuates enough that, even if the air-fuel ratio using a natural gas could be precisely controlled, there would be unacceptable Lambda fluctuations. The air-fuel ratio and control system 16 according to the present invention is self-compensating for fuel quality by monitoring engine performance with Lambda, and the engine performance is adjusted until the combustion quality indicates the engine is operating properly. Accordingly, the air-fuel ratio does not have to be measured by measuring the amounts of air or fuel delivered to the engine, rather the air-fuel ratio is adjusted until the measured pressure ratio $P_A/P_B$ and Lambda indicate that the engine is operating properly.

While the control processes of the present invention have been described above for use in conjunction with the air-fuel ratio and engine control system 16, these control processes may also be used in current engine control systems which measure Lambda as a variable. Therefore, Lambda can be determined using the measured pressure ratio $P_A/P_B$ as directed by the control process above, and this value for Lambda can then be used in other engine control systems which currently use EGO sensors to calculate Lambda. Since EGO sensors cannot accurately measure Lambda for very lean air-fuel mixtures, using the control process of the present invention to determine Lambda in these existing engine control systems allows for more precise control of Lambda. Furthermore, the control process of the present invention may be used in conjunction with the EGO sensors in order to check the accuracy of the EGO sensors when calculating Lambda.

In an alternative embodiment of the present invention, rather than using measured values for the cylinder pressure ratio and comparing these measured values to predetermined target ratios in order to adjust the air-fuel ratio to reach the target ratio, the variation in the measured pressure ratio PAPB over time when the engine is operating in a steady condition can be monitored to determine when the air-fuel ratio approaches its lean limit. As the air-fuel ratio approaches the lean limit, the variation in the measured pressure ratio $P_A/P_B$ increases, which indicates that the performance of the engine during combustion is not consistently repeating uniformly from cycle to cycle. When this occurs and the air-fuel ratio is too lean, the engine will usually run rough. Therefore, measuring the variation in the measured pressure ratio $P_A/P_B$, such as by measuring the standard deviation of the measured pressure ratio $P_A/P_B$, provides indication as to when the air-fuel ratio is approaching the lean limit. Once the standard deviation in the measured pressure ratio $P_A/P_B$ exceeds a predetermined limit, the air-fuel ratio control system 16 will know that the engine is operating too lean and will add more fuel to the air-fuel mixture. Accordingly, monitoring the variation in the measured pressure ratio $P_A/P_B$ provides a simple and effective method of maintaining the air-fuel ratio near the lean limit without operating too lean.

While the present invention has been described in conjunction with a system for controlling the air-fuel ratio in an internal combustion engine, the above-described present invention can also be implemented in a system controlling the Exhaust Gas Recirculation (EGR) rate in an internal combustion engine by monitoring the quality of combustion using the cylinder pressure ratio, as described above. This embodiment of the present invention would function equivalently as the previously described embodiments; however, rather than adjusting the air-fuel ratio, this alternative embodiment would adjust the EGR rate. The EGR rate can be controlled in order to control the quality of combustion by monitoring the cylinder pressure ratio, because changes in the EGR rate have a similar effect on combustion as changes in the excess air ratio. This result occurs since, whether the EGR rate is increased or more air is added to the air-fuel mixture, the cylinder charge is diluted with a substance that is not used to burn fuel. Therefore, increasing or decreasing the EGR rate has a similar respective effect as increasing or decreasing the amount of air in the air-fuel mixture, and the EGR rate can similarly be controlled in order to control the combustion quality. It is further possible to control both the EGR rate and the air-fuel ratio in order to achieve the desired combustion quality and the desired tradeoff between emissions and performance.

As can be seen from the foregoing, a system for controlling the air-fuel ratio in an internal combustion engine in accordance with the present invention will provide a precise method of controlling the air-fuel ratio by monitoring the quality of combustion in each cylinder, without having to measure the amount of air or fuel actually input into or output from the cylinder. Moreover, a system for controlling the air-fuel ratio in accordance with the present invention allows the engine to be accurately controlled when operating under lean burn conditions. Additionally, a system for controlling the air-fuel ratio in accordance with the present invention allows the engine to be accurately controlled for different qualities or blends of fuel.

What is claimed is:

1. A system for controlling an air-fuel ratio of an internal combustion engine, comprising:

a cylinder pressure sensor for detecting a first cylinder pressure measured at a predetermined crank angle before top dead center and a second cylinder pressure measured at a predetermined crank angle after top dead center in a combustion chamber of the internal combustion engine; said cylinder pressure sensor providing signals indicative of the cylinder pressure detected;

control means for controlling at least one of a quantity of air and a quantity of fuel delivered to the engine to control an actual air-fuel ratio;

operation detecting means for sensing at least one engine operating condition and providing output signals indicative of the operating conditions sensed;

an electronic control module including:

receiving means for receiving said signals from said cylinder pressure sensor;

computing means for computing a measured pressure ratio of said first cylinder pressure and said second cylinder pressure from signals received from said cylinder pressure sensor;

a cylinder pressure ratio information storage means for storing optimal cylinder pressure ratios for various engine operating conditions;

an excess air ratio information storage means containing optimal excess air ratios for various engine operating conditions; each of said optimal excess air ratios in said information storage means corresponding to one of said stored optimal cylinder pressure ratios for a specific set of engine operating conditions;

comparison means for comparing said measured pressure ratio with an optimal cylinder pressure ratio stored in said cylinder pressure ratio information storage means corresponding to a specific set of engine operating conditions sensed by said operation detecting means and determining an adjusted air-fuel ratio;

adjusting means for controlling said control means to adjust at least one of the quantity of air and the quantity of fuel delivered to the engine to thereby achieve said adjusted air-fuel ratio corresponding to said stored optimal pressure ratio.

2. A system for controlling an air-fuel ratio of an internal combustion engine, comprising:

a cylinder pressure sensor for detecting a first cylinder pressure measured at a predetermined crank angle before top dead center and a second cylinder pressure measured at a predetermined crank angle after top dead center in a combustion chamber of the internal combustion engine; said cylinder pressure sensor providing signals indicative of the cylinder pressure detected;

control means for controlling at least one of a quantity of air and a quantity of fuel delivered to the engine to control an actual air-fuel ratio;

estimating means for estimating a desired air-fuel ratio based upon the current engine operating conditions; said estimating means providing a control signal to said control means for adjusting the air-fuel ratio to equal said desired air-fuel ratio prior to taking said cylinder pressure measurements;

operation detecting means for sensing at least one engine operating condition and providing output signals indicative of the operating conditions sensed;

an electronic control module including:

receiving means for receiving said signals from said cylinder pressure sensor;

computing means for computing a measured pressure ratio of said first cylinder pressure and said second cylinder pressure from signals received from said cylinder pressure sensor;

a cylinder pressure ratio information storage means for storing optimal cylinder pressure ratios for various engine operating conditions;

comparison means for comparing said measured pressure ratio with an optimal cylinder pressure ratio stored in said cylinder pressure ratio information storage means corresponding to a specific set of engine operating conditions sensed by said operation detecting means and determining an adjusted air-fuel ratio wherein said comparison means compares a measured excess air ratio obtained from a corresponding measured cylinder pressure ratio with an optimal excess air ratio stored in said information storage means for the specific engine operating conditions currently being sensed and determines said adjusted air-fuel ratio, wherein said adjusted air-fuel ratio corresponds to said stored optimal excess air ratio;

adjusting means for controlling said control means to adjust at least one of the quantity of air and the quantity of fuel delivered to the engine to thereby achieve said adjusted air-fuel ratio corresponding to said stored optimal pressure ratio.

3. The system for controlling an air-fuel ratio of an internal combustion engine as defined in claim 2, further including averaging means for computing an average excess air ratio obtained from said measured pressure ratios over a plurality of combustion cycles; said comparison means comparing said average excess air ratio with said stored optimal excess air ratio for the specific set of engine operating conditions sensed to determine said adjusted air-fuel ratio.

4. The system for controlling an air-fuel ratio of an internal combustion engine as defined in claim 2, further including estimating means for estimating a desired air-fuel ratio based upon a set of engine operating conditions sensed; said estimating means providing a control signal to said control means to adjust said actual air-fuel ratio to equal said desired air-fuel ratio prior to taking said first and second cylinder pressure measurements.

5. A system for controlling an air-fuel ratio of an internal combustion engine, comprising:

a cylinder pressure sensor for detecting a first cylinder pressure and a second cylinder pressure in a combustion chamber of the internal combustion engine; said cylinder pressure sensor providing a signal indicative of the cylinder pressure detected;

control means for controlling at least one of a quantity of air and a quantity of fuel delivered to the engine to control an actual air-fuel ratio;

an electronic control module including:

receiving means for receiving said signals from said cylinder pressure sensor and said operation detecting means;

computing means for computing a measured pressure ratio of said first cylinder pressure measured at a predetermined crank angle before top dead center and said second cylinder pressure measured at a predetermined crank angle after top dead center from signals received from said cylinder pressure sensor;

an excess air ratio information storage means containing an optimal excess air ratio for the engine;

conversion means for converting said measured pressure ratio of measured cylinder pressures into a measured excess air ratio;

comparison means for comparing said measured excess air ratio with an optimal excess air ratio stored in said excess air ratio information storage means and determining an adjusted air-fuel ratio;

adjusting means for adjusting at least one of the quantity of air and the quantity of fuel delivered to the engine by said control means to achieve said adjusted air-fuel ratio corresponding to said optimal excess air ratio.

6. The system for controlling an air-fuel ratio of an internal combustion engine as defined in claim 5, further comprising:

operation detecting means for sensing at least one engine operating condition and providing output signals indicative of the operating conditions sensed;

wherein said excess air ratio information storage means contains optimal excess air ratios for various engine operating conditions;

wherein said comparison means compares said measured excess air ratio with an optimal excess air ratio stored in said excess air ratio information storage means for the engine operating conditions sensed when determining said adjusted air-fuel ratio.

7. The system for controlling an air-fuel ratio of an internal combustion engine as defined in claim 6, further including averaging means for computing an average measured excess air ratio obtained from said measured pressure ratios over a plurality of combustion cycles; said comparison means comparing said average measured excess air ratio with said stored optimal excess air ratio for the specific engine operating conditions currently being sensed to determine said adjusted air-fuel ratio.

8. The system for controlling an air-fuel ratio of an internal combustion engine as defined in claim 6, further including filtering means for filtering said measured cylinder pressures over a plurality of combustion cycles and providing filtered measured cylinder pressure signals; said filtered measured cylinder pressure signals being used to compute said measured pressure ratio.

9. The system for controlling an air-fuel ratio of an internal combustion engine as defined in claim 6, further including estimating means for determining a desired air-fuel ratio based upon the current engine operating conditions; said estimating means providing a control signal to said control means to adjust said actual air-fuel ratio to equal said desired air-fuel ratio prior to taking said cylinder pressure measurements.

10. The system for controlling an air-fuel ratio of an internal combustion engine as defined in claim 6, wherein said predetermined crank angle before top dead center and said predetermined crank angle after top dead center are substantially the same.

11. The system for controlling an air-fuel ratio of an internal combustion engine as defined in claim 10, wherein said predetermined crank angle is in the range of approximately 10–30 degrees.

12. The system for controlling an air-fuel ratio of an internal combustion engine as defined in claim 6, further including offset means for measuring a cylinder pressure at bottom dead center and a pressure in the intake manifold and determining an offset of said cylinder pressure sensor based upon the difference between the measured cylinder pressure and intake manifold pressure at bottom dead center.

13. The system for controlling an air-fuel ratio of an internal combustion engine as defined in claim 6, further including compensation means for determining the gain of the cylinder pressure sensor.

14. The system for controlling an air-fuel ratio of an internal combustion engine as defined in claim 13, wherein said compensation means calculates a gain ratio of cylinder pressures measured at two crank angles before top dead center and compares said gain ratio with a target ratio to determine the gain of the cylinder pressure sensor.

15. The system for controlling an air-fuel ratio of an internal combustion engine as defined in claim 14, wherein one of said two crank angles is approximately 180 degrees before top dead center.

16. The system for controlling an air-fuel ratio of an internal combustion engine as defined in claim 6, wherein said air-fuel ratio is controlled and adjusted without ever measuring at least one of the quantity of air and the quantity of fuel actually delivered to the engine.

17. The system for controlling an air-fuel ratio of an internal combustion engine as defined in claim 6, further including learning means for monitoring the difference between said measured pressure ratio and said optimal pressure ratio for the specific set of engine operating conditions sensed;

said learning means storing said difference and said specific set of engine operating conditions sensed in memory;

wherein said learning means provides a control signal to said control means to adjust said actual air-fuel ratio to equal said optimal air-fuel ratio prior to taking said first and second cylinder pressure measurements when sensing a similar set of engine operating conditions previously monitored.

18. The system for controlling an air-fuel ratio of an internal combustion engine as defined in claim 6, wherein said comparison means further compares said measured pressure ratio with a predetermined threshold to detect when a cylinder misfire has occurred; said comparison means providing a control signal to said control means to alter at least one of the amount of air and fuel delivered to the engine to alter said actual air-fuel ratio when a cylinder misfire is detected.

19. A method of controlling an air-fuel ratio of an internal combustion engine, comprising the steps of:

measuring a cylinder pressure in a combustion chamber of the internal combustion engine with a cylinder pressure sensor at a predetermined crank angle before top dead center and at a predetermined crank angle after top dead center;

computing a measured cylinder pressure ratio from said measured cylinder pressures;

comparing said computed cylinder pressure ratio with a predetermined optimal cylinder pressure ratio and generating a corrective signal;

adjusting at least one of a quantity of air and a quantity of fuel delivered to the engine as a function of said corrective signal to achieve an optimal air-fuel ratio;

sensing at least one engine operating condition and providing output signals indicative of the operating conditions sensed; and generating a predetermined optimal cylinder pressure ratio corresponding to said sensed engine operating conditions;

wherein said computed cylinder pressure ratio is compared with said predetermined optimal cylinder pressure ratio for the operating conditions sensed;

generating a measured excess air ratio corresponding to said measured cylinder pressure ratio;

generating a predetermined optimal excess air ratio;

comparing said measured excess air ratio with said predetermined optimal excess air ratio to generate said corrective signal.

20. The method of controlling an air-fuel ratio of an internal combustion engine as defined in claim 19, further comprising the steps of:

computing an average measured excess air ratio over a plurality of combustion cycles; and comparing said average measured excess air ratio with said predetermined optimal excess air ratio for a set of engine operating sensed to generate said corrective signal.

21. The method for controlling an air-fuel ratio of an internal combustion engine as defined in claim 19, further comprising the steps of:

estimating a desired air-fuel ratio based upon the sensed engine operating conditions; and adjusting said actual air-fuel ratio to equal said desired air-fuel ratio prior to taking said cylinder pressure measurements.

22. A method of controlling an air-fuel ratio of an internal combustion engine, comprising the steps of:

measuring a cylinder pressure in a combustion chamber of the internal combustion engine with a cylinder pressure sensor at a predetermined crank angle before top dead center and at a predetermined crank angle after top dead center;

computing a measured cylinder pressure ratio from said measured cylinder pressures;

converting said measured cylinder pressure ratio into a corresponding measured excess air ratio;

comparing said measured excess air ratio with a predetermined optimal excess air ratio and generating a corrective signal;

adjusting at least one of the quantity of air and the quantity of fuel delivered to the engine as a function of said corrective signal.

23. The method of controlling an air-fuel ratio of an internal combustion engine as defined in claim 22, further comprising the steps of:

sensing at least one engine operating condition and providing output signals indicative of the operating conditions sensed; and generating a predetermined optimal excess air ratio corresponding to said sensed engine operating conditions;

wherein said measured excess air ratio is compared with said predetermined optimal excess air ratio for the operating conditions sensed when generating a corrective signal.

24. The method of controlling an air-fuel ratio of an internal combustion engine as defined in claim 23, further comprising the steps of:

computing an average measured excess air ratio for said measured excess air ratio measured over a plurality of combustion cycles; and comparing said average measured excess air ratio with said predetermined optimal excess air ratio for the specific engine operating conditions currently being sensed to generate said corrective signal.

25. The method for controlling an air-fuel ratio of an internal combustion engine as defined in claim 23, further comprising the steps of:

estimating a desired air-fuel ratio based upon the current engine operating conditions; and adjusting the air-fuel ratio to equal said desired air-fuel ratio prior to taking said cylinder pressure measurements.

26. The method of controlling an air-fuel ratio of an internal combustion engine as defined in claim 23, wherein said predetermined crank angle before top dead center and said predetermined crank angle after top dead center are substantially the same.

27. The method of controlling an air-fuel ratio of an internal combustion engine as defined in claim 26, wherein said predetermined crank angle is in the range of approximately 10–30 degrees.

28. The method of controlling an air-fuel ratio of an internal combustion engine as defined in claim 23, wherein said air-fuel ratio is controlled and adjusted without ever measuring at least one the quantity of air and the quantity of fuel actually delivered to the engine.

29. The method of controlling an air-fuel ratio of an internal combustion engine as defined in claim 23, further comprising the steps of measuring a cylinder pressure at bottom dead center and a pressure in the intake manifold and determining an offset of said cylinder pressure sensor based upon the difference between said measured cylinder pressure at bottom dead center and said intake manifold pressure.

30. The method of controlling an air-fuel ratio of an internal combustion engine as defined in claim 23, further comprising the step of calculating a gain ratio of cylinder pressures measured at two crank angles before top dead center and comparing said gain ratio with a target pressure ratio to determine a gain of the cylinder pressure sensor.

31. The method of controlling an air-fuel ratio of an internal combustion engine as defined in claim 30, wherein one of said two crank angles is approximately 180 degrees before top dead center.

32. The method of controlling an air-fuel ratio of an internal combustion engine as defined in claim 23, further comprising the step of filtering said measured cylinder pressures over a plurality of combustion cycles and providing filtered measured cylinder pressure signals; said filtered measured cylinder pressure signals being used to compute said measured pressure ratio.

33. The method of controlling an air-fuel ratio of an internal combustion engine as defined in claim 23, further comprising the steps:

monitoring the difference between said measured pressure ratio and said optimal pressure ratio for the specific set of engine operating conditions sensed;

storing said difference and said specific set of engine operating conditions sensed; and adjusting said air-fuel ratio to equal said optimal air-fuel ratio prior to taking said first and second cylinder pressure measurements when sensing a similar set of engine operating conditions previously monitored in order to minimize the difference between said measured pressure ratio said optimal pressure ratio.

34. The method of controlling an air-fuel ratio of an internal combustion engine as defined in claim 23, further comprising the steps of:

comparing said measured pressure ratio with a predetermined threshold to detect when a cylinder misfire has occurred; and providing a control signal to said control means to alter at least one of the amount of air and fuel delivered to the engine to alter said actual air-fuel ratio when a cylinder misfire is detected.

* * * * *